US007722380B1

(12) United States Patent
West et al.

(10) Patent No.: US 7,722,380 B1
(45) Date of Patent: May 25, 2010

(54) PLUG RETENTION DEVICE

(75) Inventors: David W. West, Naperville, IL (US); Thomas G. Stanford, Orland Park, IL (US); Veselko J. Sladin, Alsip, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/412,520

(22) Filed: Mar. 27, 2009

(51) Int. Cl.
*H01R 13/62* (2006.01)

(52) U.S. Cl. ..... 439/373

(58) Field of Classification Search ..... 439/368, 439/369, 370, 371, 373
See application file for complete search history.

(56) References Cited

U.S. PATENT DOCUMENTS

| | | | | |
|---|---|---|---|---|
| 4,652,069 | A | 3/1987 | Smith | |
| 4,789,353 | A | 12/1988 | Busta et al. | |
| 5,044,976 | A | 9/1991 | Thompson | |
| 5,336,107 | A | 8/1994 | Sheryll | |
| 5,348,495 | A | 9/1994 | Kasden | |
| 5,409,394 | A | 4/1995 | Astier | |
| 5,575,677 | A | 11/1996 | Buckner et al. | |
| 5,593,313 | A | 1/1997 | Shibuya et al. | |
| 5,620,336 | A | 4/1997 | Worthing | |
| 5,655,924 | A | 8/1997 | Cross et al. | |
| 5,860,827 | A | 1/1999 | Lee | |
| 5,928,023 | A | 7/1999 | Buckner et al. | |
| 5,934,919 | A | 8/1999 | Cross et al. | |
| 5,989,052 | A | 11/1999 | Fields et al. | |
| 6,071,142 | A | 6/2000 | Blackman | |
| 6,276,952 | B1 | 8/2001 | Ferranti et al. | |
| 6,319,044 | B1 * | 11/2001 | Stekelenburg | 439/369 |
| 6,491,539 | B1 | 12/2002 | Johnston | |
| 6,521,831 | B1 | 2/2003 | Gretz | |
| 6,767,237 | B1 | 7/2004 | Shih | |
| 6,769,930 | B1 | 8/2004 | McDevitt, Jr. | |
| 6,939,161 | B1 | 9/2005 | Yi et al. | |
| 6,981,888 | B2 * | 1/2006 | O'Keefe et al. | 439/369 |
| 7,014,493 | B1 | 3/2006 | Battard | |
| 7,056,145 | B2 | 6/2006 | Campbell, III et al. | |
| 7,101,215 | B2 | 9/2006 | Woellner et al. | |
| 7,134,902 | B1 | 11/2006 | Lewis et al. | |
| 7,140,903 | B2 | 11/2006 | Pulizzi et al. | |
| 7,192,298 | B2 | 3/2007 | Sinner et al. | |
| 7,207,826 | B1 | 4/2007 | Yang | |
| 7,264,497 | B1 | 9/2007 | Lewis | |
| 2006/0046557 | A1 | 3/2006 | Pulizzi et al. | |
| 2008/0098571 | A1 | 5/2008 | Morris | |

* cited by examiner

*Primary Examiner*—Ross N Gushi
(74) *Attorney, Agent, or Firm*—Robert A. McCann; Christopher S. Clancy; James H. Williams

(57) ABSTRACT

Certain embodiments of the present invention provide an apparatus for retaining a plug in an outlet. The apparatus includes a body and a pair of arms slidably connected to the body. The arms are secured to the outlet. The body slides along the arms in a first direction to retain the plug in the outlet.

31 Claims, 13 Drawing Sheets

PLUG RETENTION DEVICE

BACKGROUND OF THE INVENTION

The present invention relates to a plug retention device. More particularly, the present invention relates to a plug retention device for a power outlet unit ("POU").

Plug retention devices are well known in the art. However, existing plug retention devices are difficult to install, typically requiring that the outlet be at least partially disassembled/removed prior to installation. Additionally, existing plug retention devices are designed for a specific type of plug, cord, and outlet.

Therefore, there is a need for a plug retention device that is easy to install, preferably without removing the outlet. There is also a need for a plug retention device that can accommodate a variety of plugs, cords, and outlets.

POU's are also well known in the art. Typically, POU's are installed in network cabinets to provide power to one or more network components, such as servers and switches, installed therein. The network components are connected to the POU's via one or more power cords. However, when the network cabinet is crowded, which is typically the case, as most data centers are limited in space, the power cords are easily disconnected, and even if the power cords remain connected, the connections are difficult to identify.

Therefore, there is a need for a plug retention device for a power outlet unit. There is also a need for a plug retention device that includes a plug identification area.

SUMMARY OF THE INVENTION

Certain embodiments of the present invention provide an apparatus for retaining a plug in an outlet. The apparatus includes a body and a pair of arms slidably connected to the body. The arms are secured to the outlet. The body slides along the arms in a first direction to retain the plug in the outlet.

DETAILED DESCRIPTION OF THE INVENTION

FIGS. 1-20 illustrate a plug retention device 100 according to an embodiment of the present invention.

Figure 1:
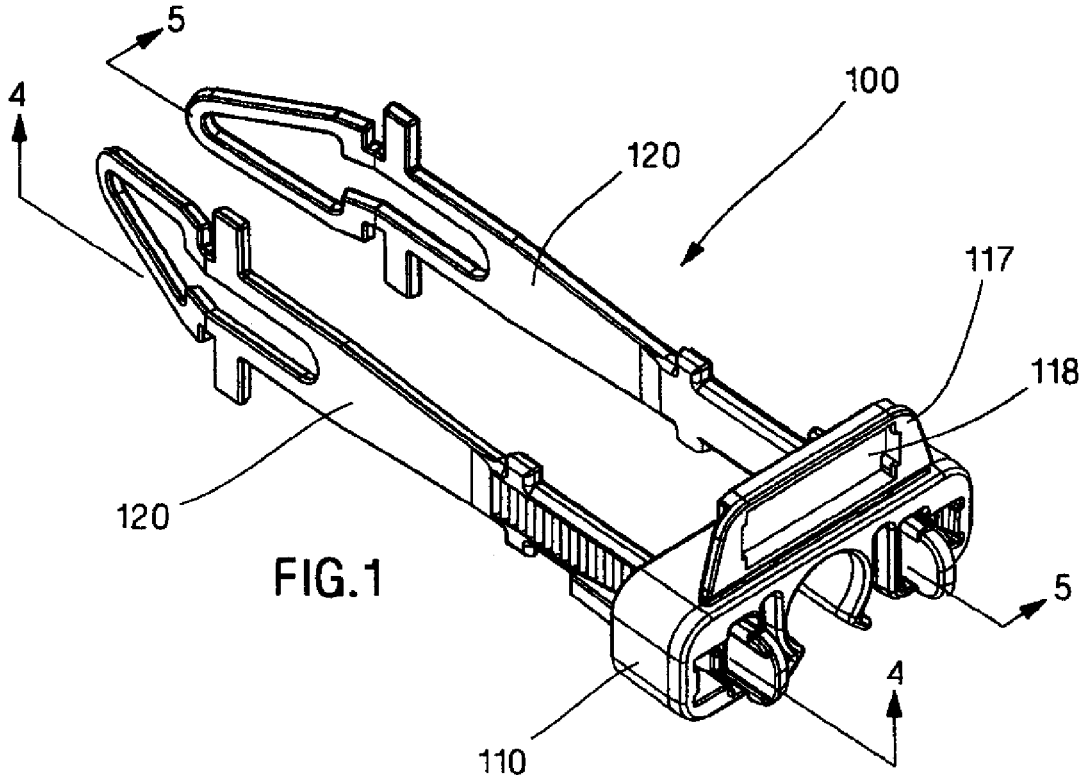
FIG. 1 is a top front perspective view of a plug retention device according to an embodiment of the present invention.
Figure 2:
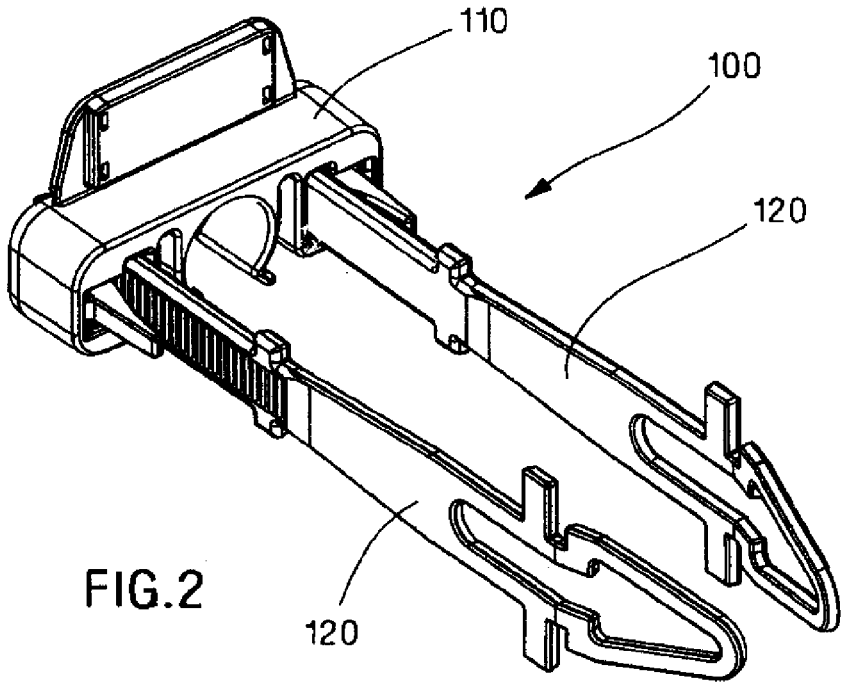
FIG. 2 is a top back perspective view of the plug retention device of FIG. 1.
Figure 3:
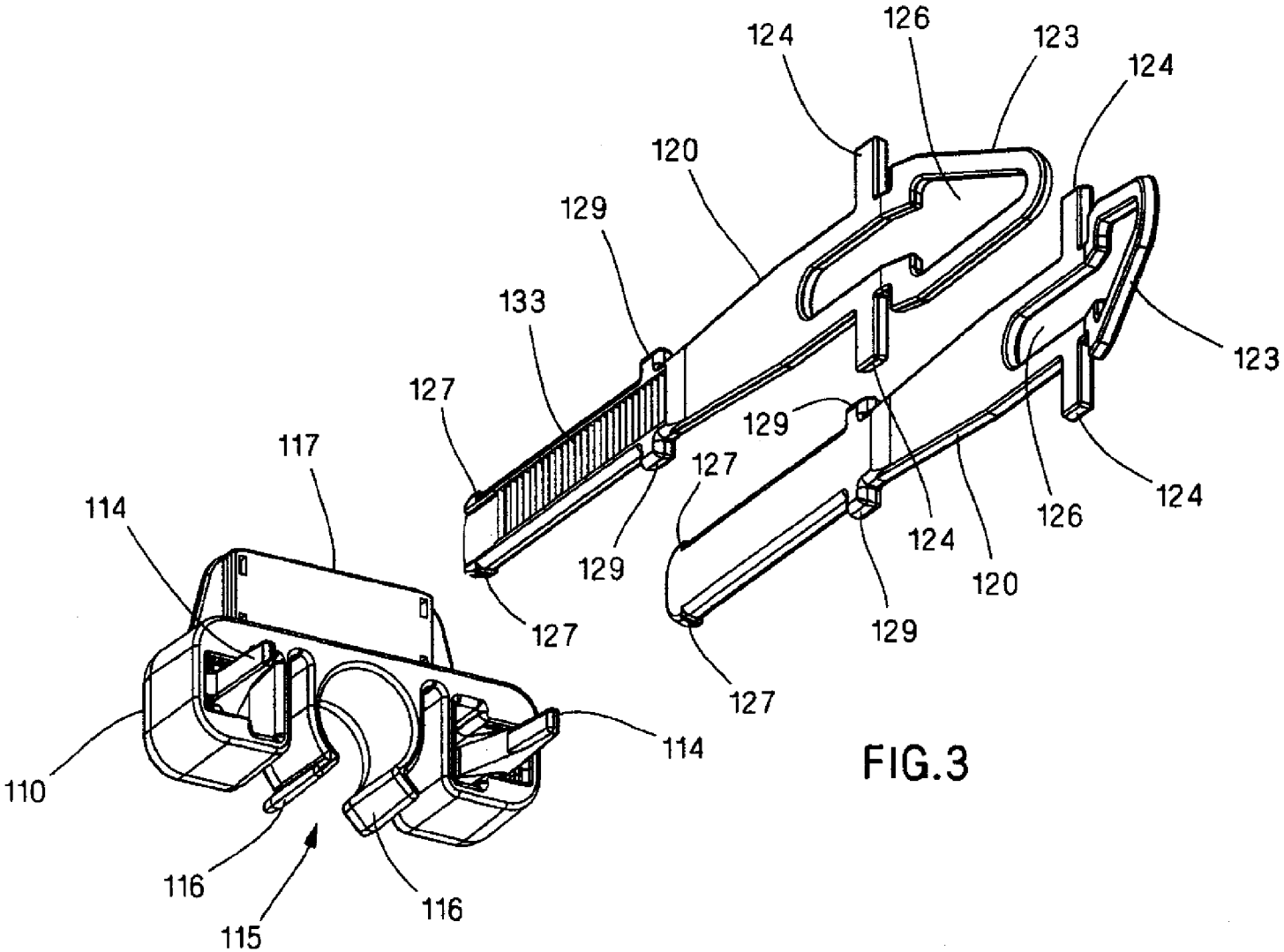
FIG. 3 is an exploded bottom back perspective view of the plug retention device of FIG. 1.

As best seen in FIGS. 1-3, the plug retention device 100 includes a body 110 and a pair of arms 120 slidably connected to the body 110.

Figure 4:
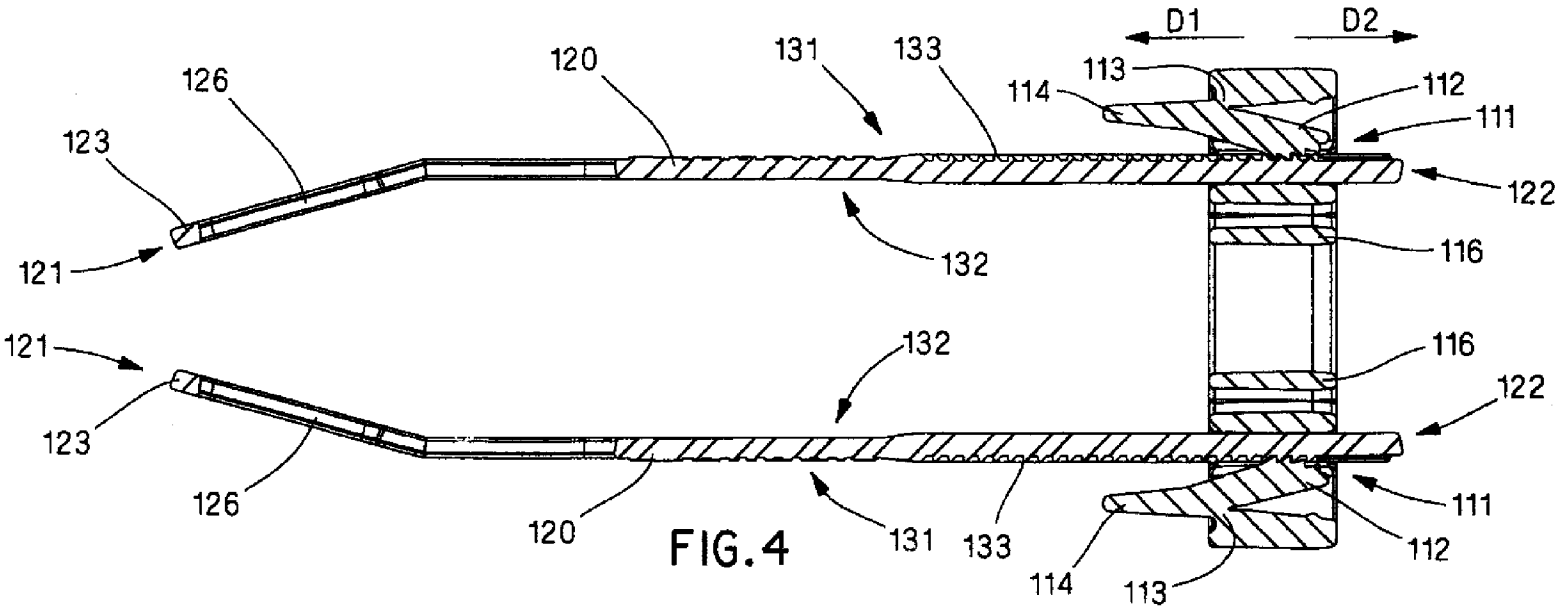
FIG. 4 is a cross-sectional view taken along line 4-4 of FIG. 1.

As best seen in FIG. 4, the body 110 includes a pair of slots 111. Each of the slots 111 is adapted to receive one of the arms 120. More particularly, each of the slots 111 includes a locking wedge 112, which allows the body 110 to slide along the arms 120 in a first direction D1 and prevents the body 110 from sliding along the arms 120 in a second direction D2, similar to that of a cable tie, such as the PAN-TY® Cable Tie (Panduit Corporation, Tinley Park, Ill.). The locking wedge 112 is rotatably connected to the body 110 via a hinge 113, and includes a release tab 114 extending therefrom. Squeezing the release tabs 114 together causes the locking wedges 112 to rotate away from the arms 120, which allows the body 110 to slide freely along the arms 120 in the second direction D2.

Figure 5:
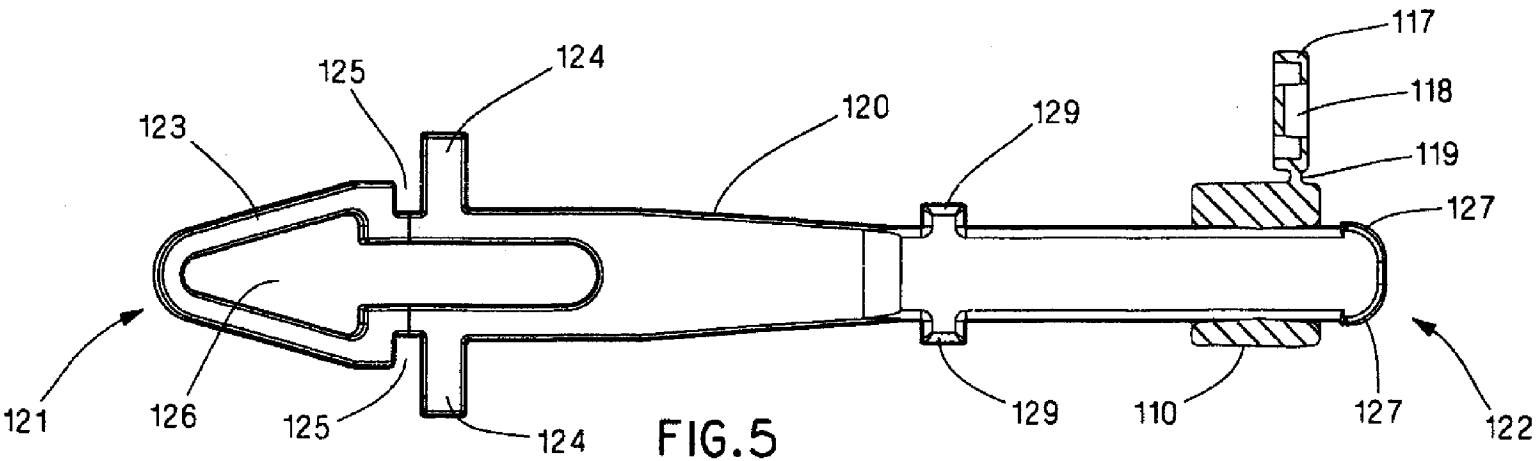
FIG. 5 is a cross-sectional view taken along line 5-5 of FIG. 1.

As best seen in FIG. 5, each of the arms 120 includes a first end 121 and a second end 122 opposite the first end 121. The first end 121 of each arm 120 includes a tip 123. Preferably, the tip 123 is shaped like an arrow. A pair of tabs 124 is spaced apart from the tip 123 and defines a pair of recesses 125 therebetween. In certain embodiments, the first end 121 of each arm 120 may include an aperture 126, which increases the flexibility of the tip 123, and therefore, makes the arm 120 easier to "snap" or otherwise secure to an outlet, or remove therefrom.

Figure 20:
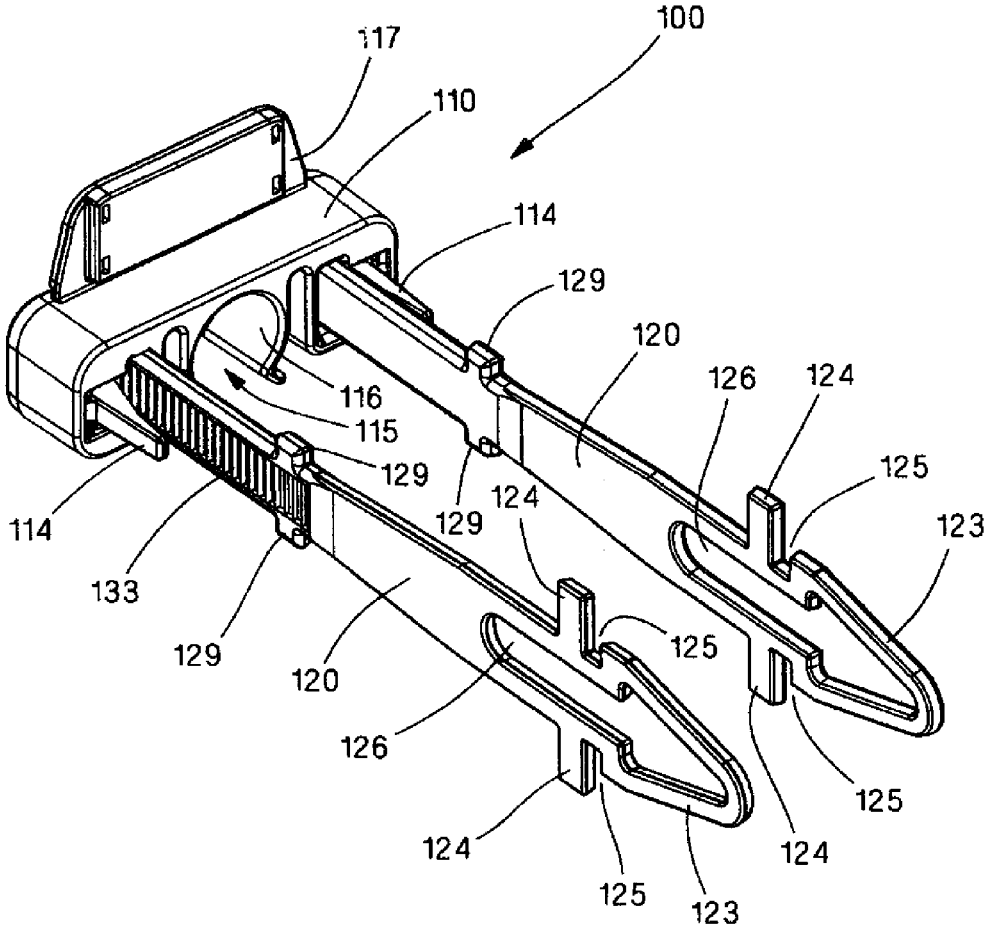
FIG. 20 is a top back perspective view of a plug retention device according to an alternative embodiment of the present invention.

Referring again to FIG. 4, the tips 123 of the arms 120 are bent. Preferably, the tips 123 are bent at an angle of 15 degrees. As best seen in FIG. 7A, when the arms 120 of the plug retention device 100 are separated to accommodate the plug 23, the tips 123 align with the slots 14 in the POU 10. Alternatively, as shown in FIG. 20, the tips 123 may be straight.

Referring again to FIG. 5, the second end 122 of each arm 120 includes a first pair of stops 127 and a second pair of stops 129 spaced apart from the first pair of stops 127. The stops 127 prevent the body 110 from sliding off of the arms 120. In certain embodiments, the second end 122 of each arm 120 may include an aperture (not shown), which increases the flexibility of the stops 127, and therefore, makes the arm 120 easier to "snap" or otherwise secure to the body 110, or remove therefrom. Similarly, the stops 129 prevent the body 110 from sliding too far along the arms 120 in the first direction D1 and potentially damaging the plug retention device 100. Together, the stops 127, 129 define a range of motion for the body 110.

As best seen in FIG. 4, each of the arms 120 includes a first side 131 (e.g., outside) and a second side 132 (e.g., inside) opposite the first side 131. The first side 131 of each arm 120 includes a plurality of teeth 133. The locking wedge 112 engages the teeth 133. Additionally, or in the alternative, the teeth 133 may be disposed on the second side 132 of each arm 120.

Figure 6:
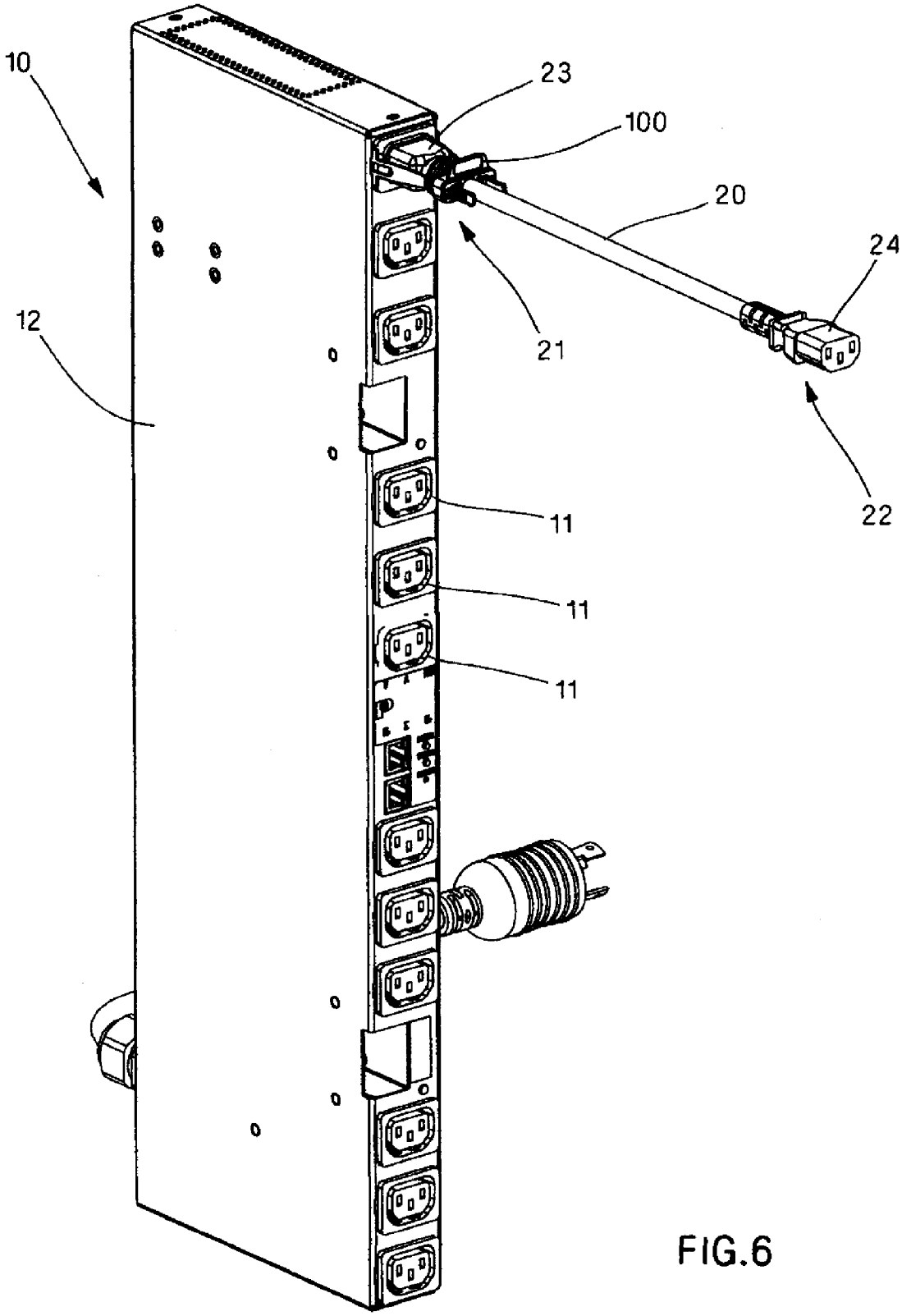
FIG. 6 is a top front perspective view of a power outlet unit ("POU") according to an embodiment of the present invention.
Figure 12:
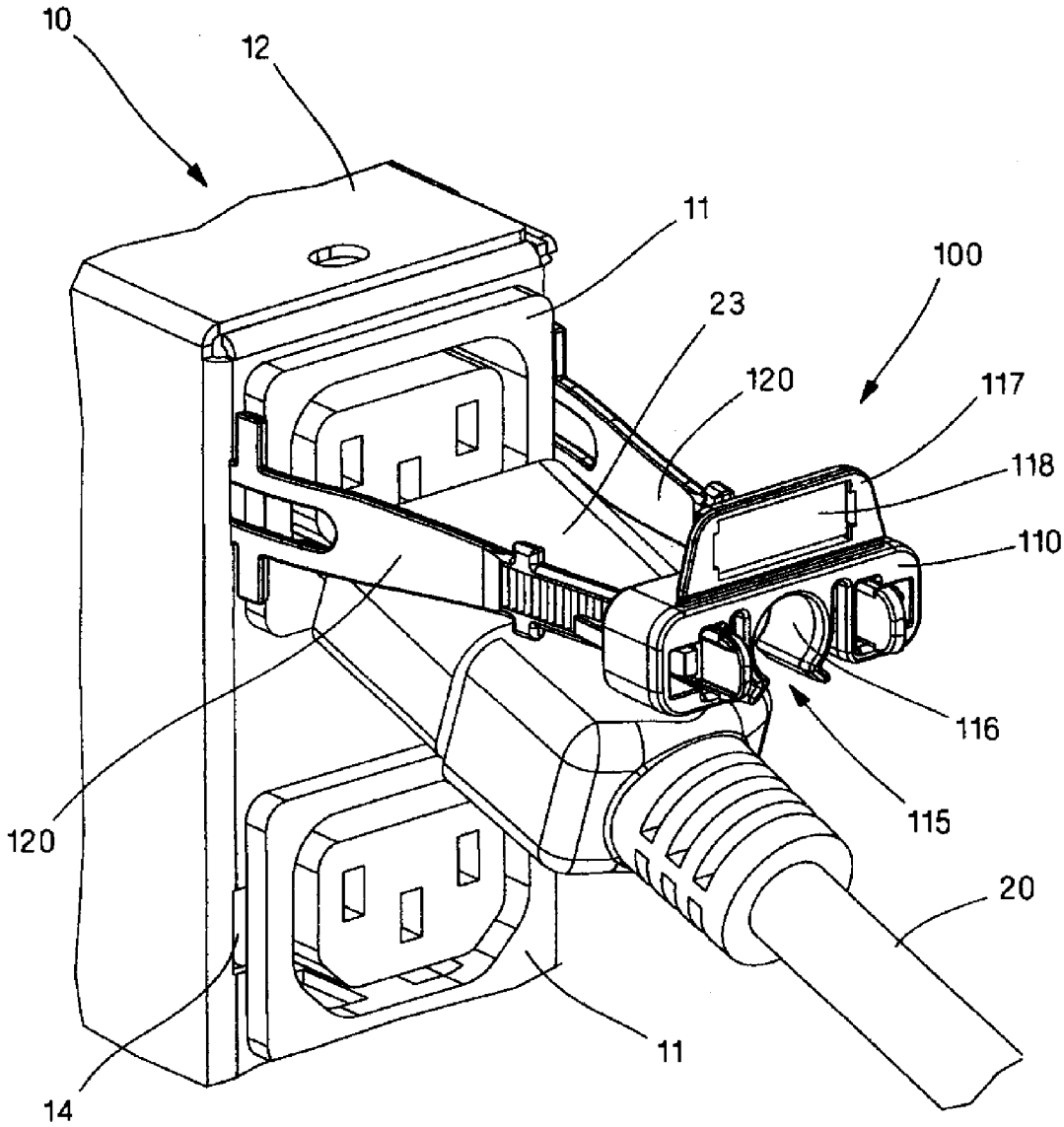
FIG. 12 is an enlarged top front perspective view of the POU of FIG. 6, showing the plug being connected to the outlet.

As best seen in FIG. 6, the plug retention device 100 is connected to a power outlet unit ("POU") 10. The POU 10 includes a plurality of outlets 11. The outlets 11 are adapted to provide power, for example, to one or more network components (not shown), such as servers and switches, in a network cabinet (not shown) via a power cord 20. The power cord 20 includes a first end 21 and a second end 22 opposite the first end 21. The first end 21 of the power cord 20 includes a first plug 23, which is connectable to one of the outlets 11 of the POU 10, as best seen in FIG. 12. The second end 22 of the power cord 20 includes a second plug 24, which is connectable to one of the network components (not shown).

Figure 7:
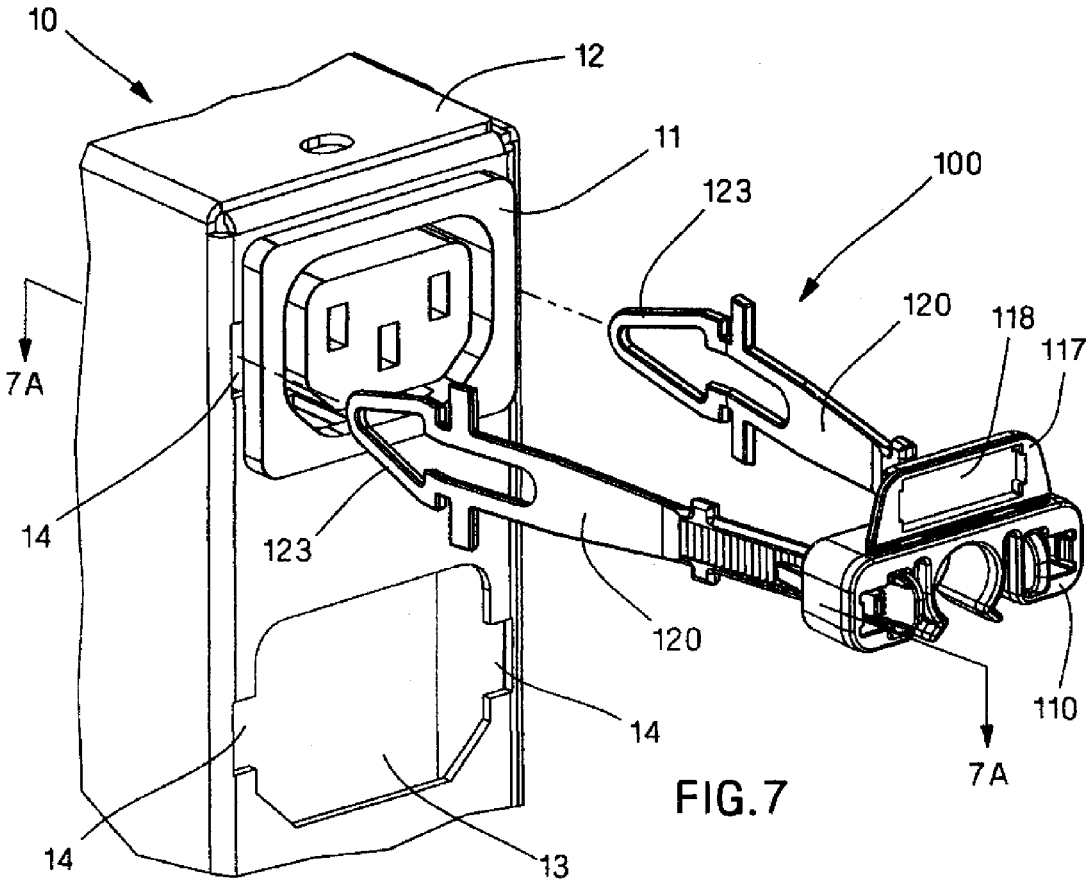
FIG. 7 is an enlarged top front perspective view of the POU of FIG. 6, showing one of the outlets removed therefrom.
Figure 7A:
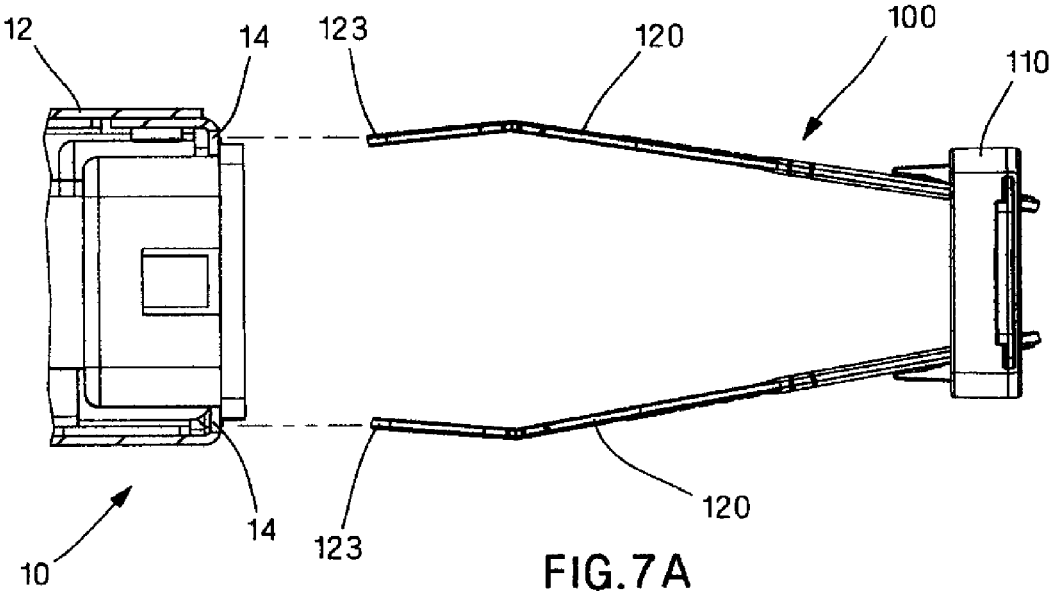
FIG. 7A is a partial cross-sectional view taken along line 7A-7A of FIG. 7.

As best seen in FIG. 7, the POU 10 includes a housing 12. The housing 12 includes a plurality of openings 13. Each of the openings 13 is adapted to receive one of the outlets 11. Together, the outlet 11 and the opening 13 define a pair of slots 14. Each of the slots 14 is adapted to receive one of the arms 120.

Figure 8:
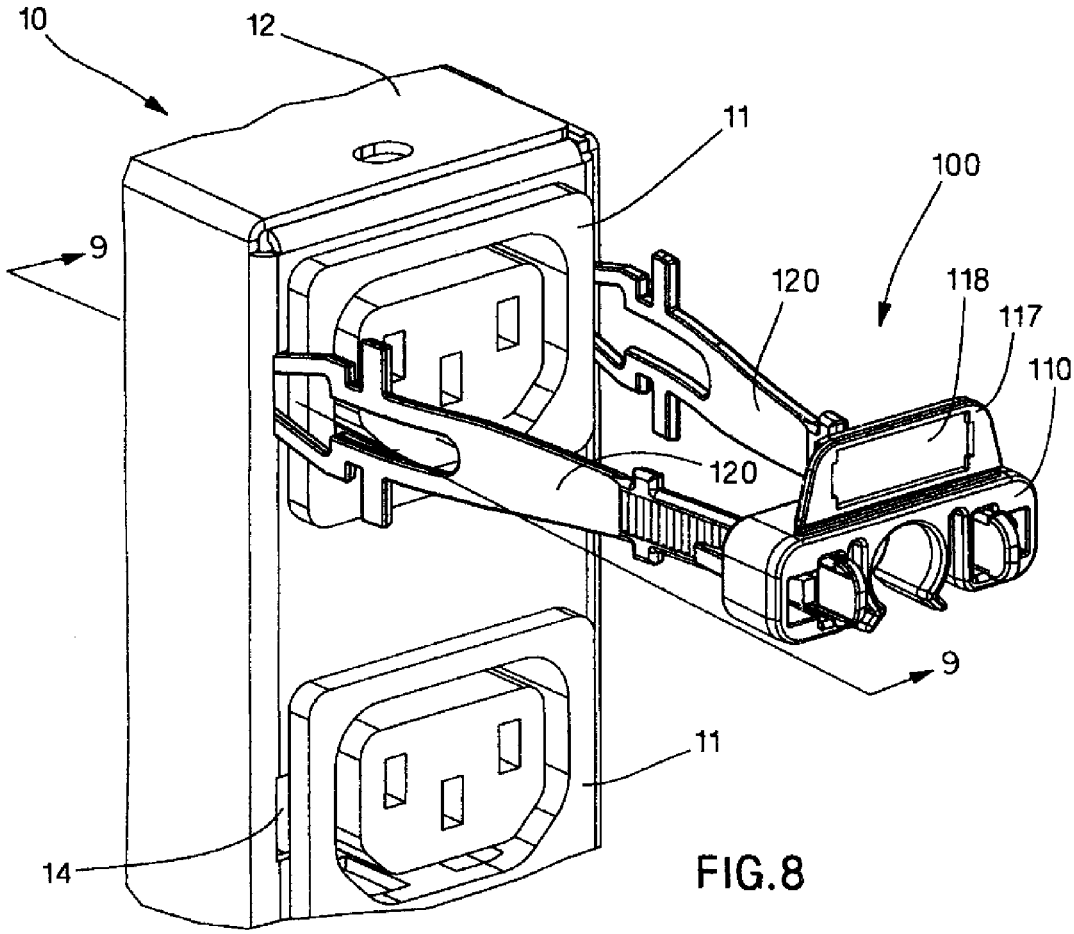
FIG. 8 is an enlarged top front perspective view of the POU of FIG. 6, showing the plug retention device of FIG. 1 partially installed.
Figure 9:
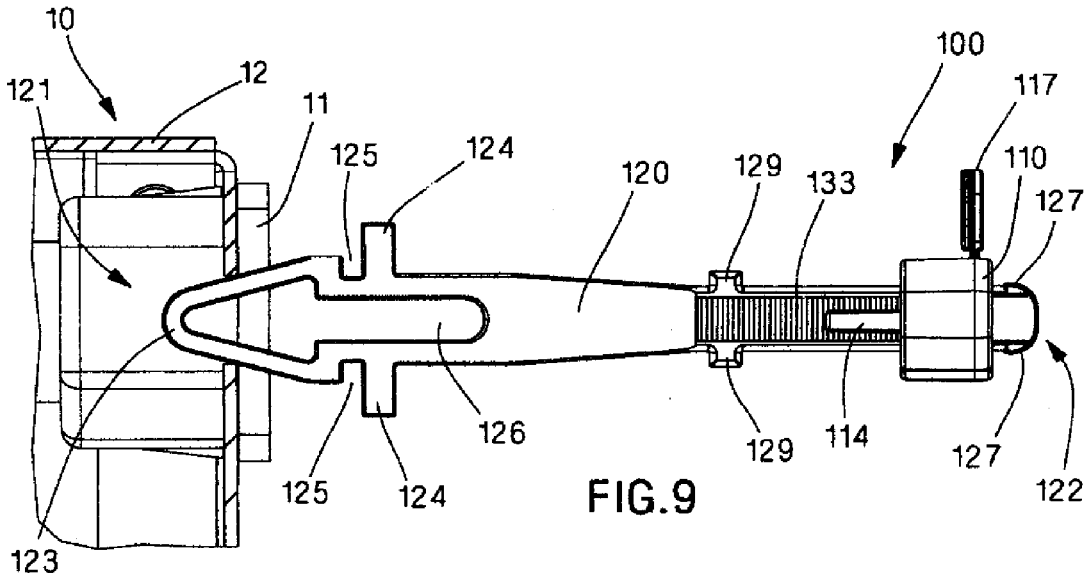
FIG. 9 is a cross-sectional view taken along line 9-9 of FIG. 8.
Figure 10:
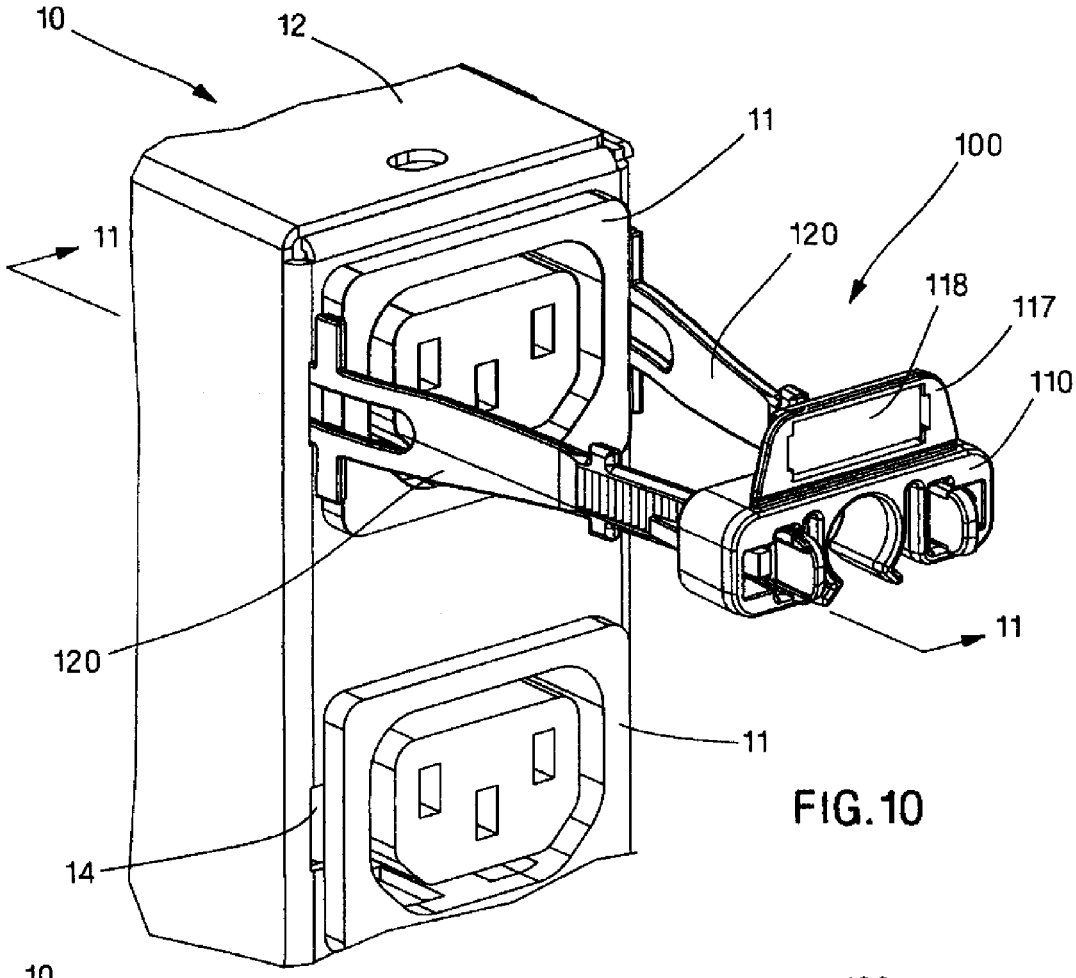
FIG. 10 is an enlarged top front perspective view of the POU of FIG. 6, showing the plug retention device of FIG. 1 fully installed.
Figure 11:
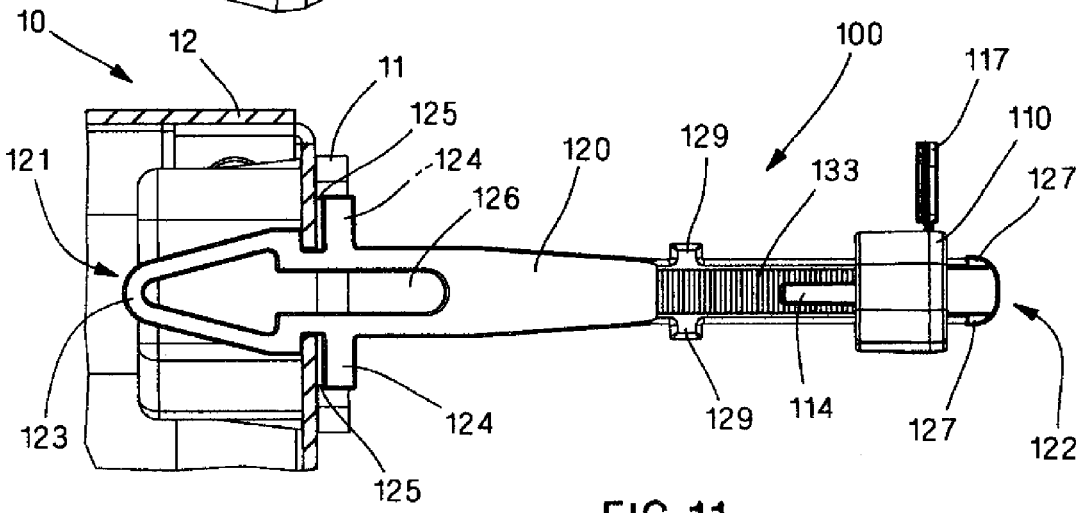
FIG. 11 is a cross-sectional view taken along line 11-11 of FIG. 10.

To secure the plug retention device 100 to the outlet 11, the tips 123 of the arms 120 are aligned with the slots 14 in the POU 10, as shown in FIG. 7 and FIG. 7A. Next, the tips 123 are inserted into the slots 14, as shown in FIG. 8 and FIG. 9. The tips 123 "snap" into the slots 14, securing the housing 12 of the POU 10 in the recesses 125 between the tips 123 and the tabs 124, as shown in FIG. 10 and FIG. 11. The tabs 124 prevent the arms 120 from being pushed too far into the slots 14.

Referring again to FIGS. 1-3, the body 110 includes a retainer 115 for the cord 20. The retainer 115 includes a pair of fingers 116. The fingers 116 are contoured to match the shape of the cord 20, and resilient to accommodate a variety of cords 20.

Figure 13:
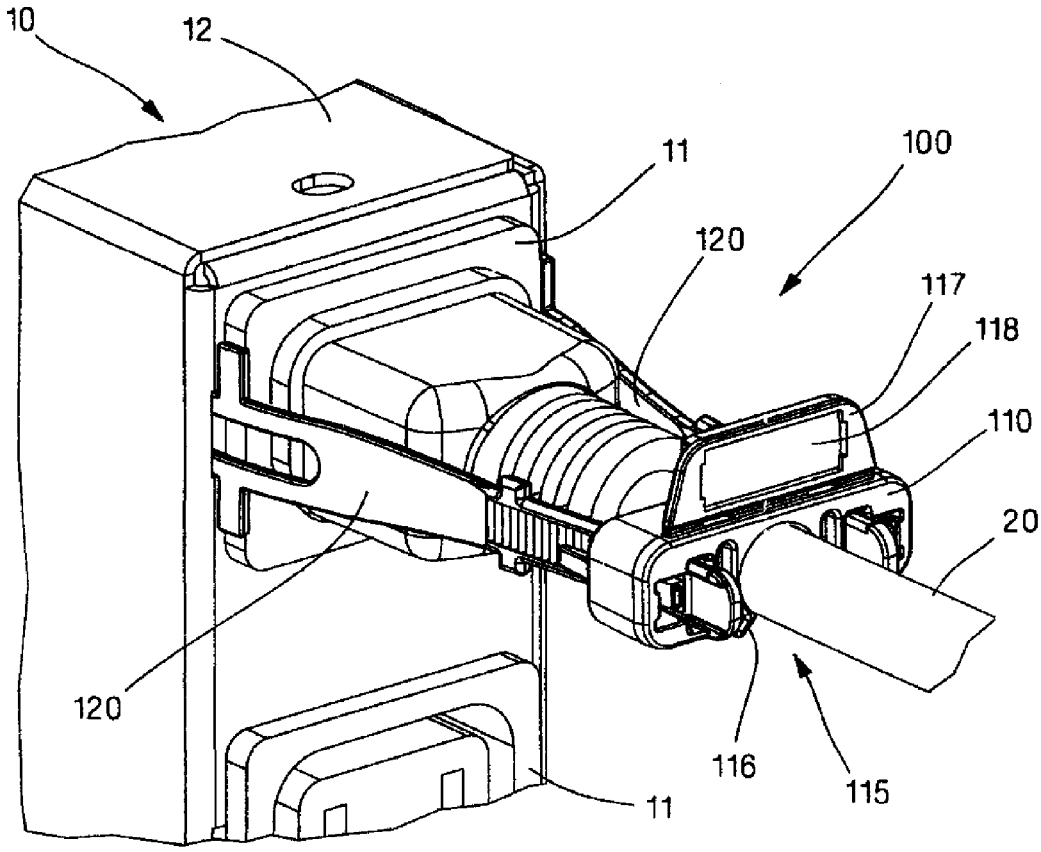
FIG. 13 is an enlarged top front perspective view of the POU of FIG. 6, showing the cord being secured to the plug retention device.
Figure 14:
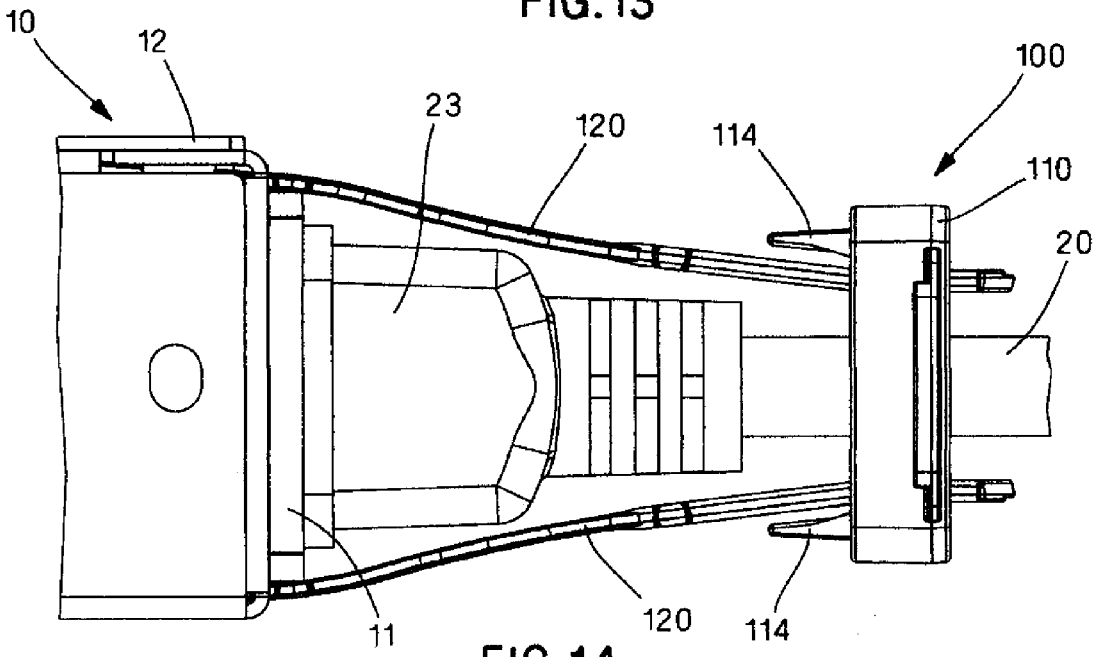
FIG. 14 is a top view of the POU of FIG. 13.
Figure 15:
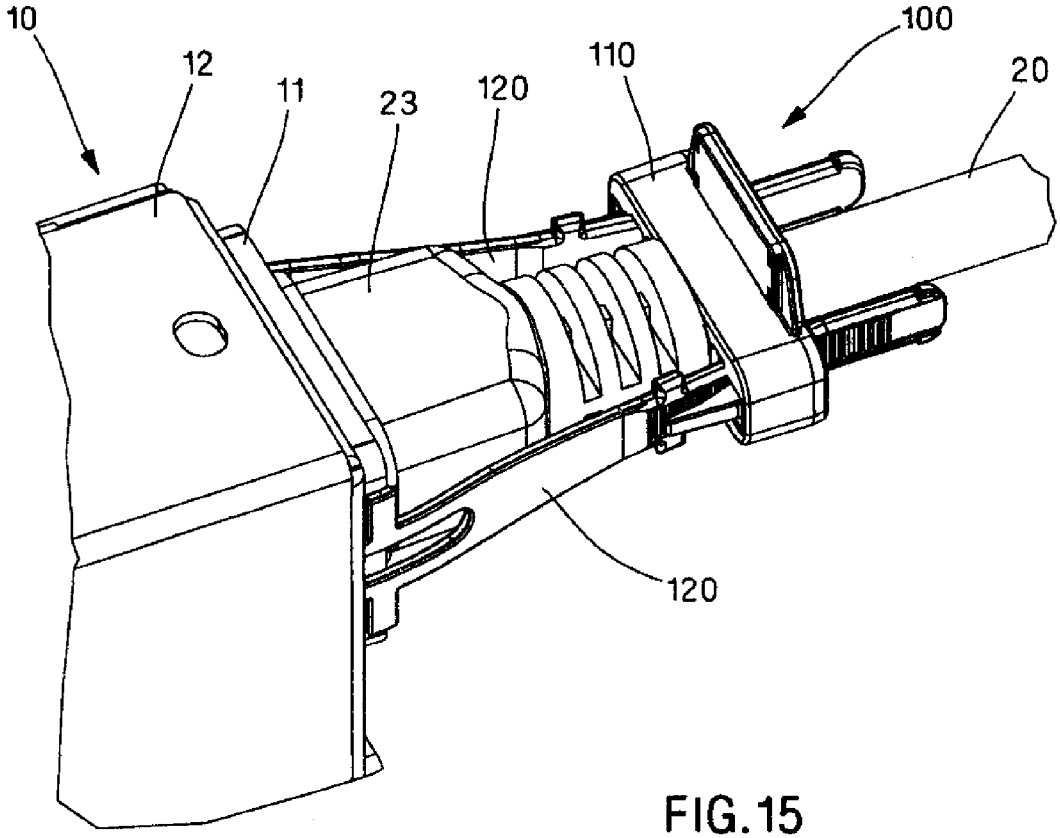
FIG. 15 is an enlarged top front perspective view of the POU of FIG. 6, showing the plug secured to the plug retention device.
Figure 16:
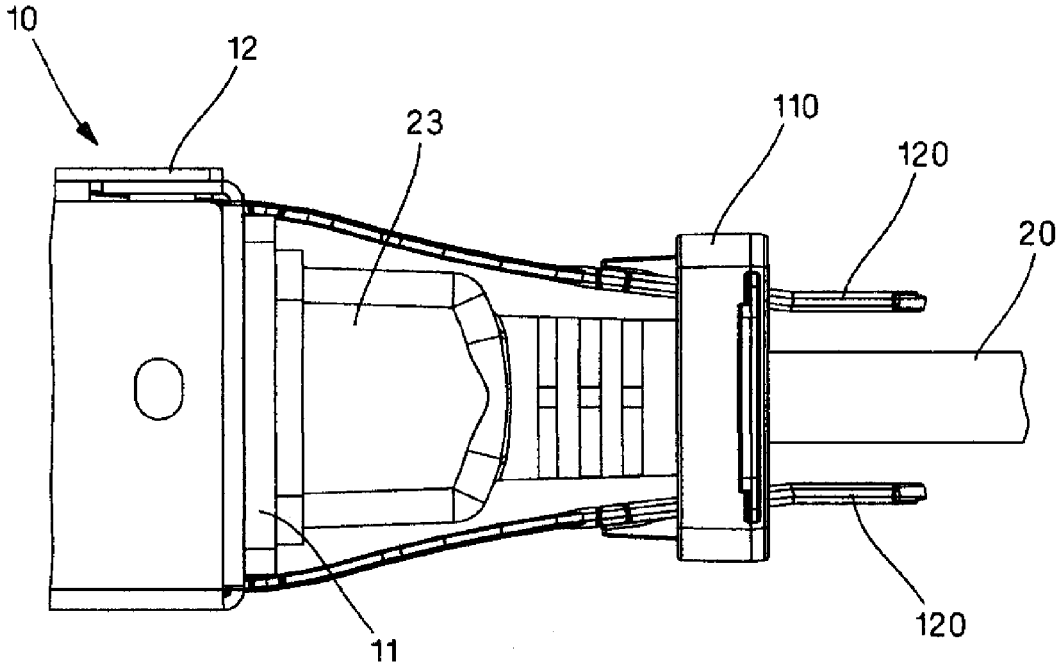
FIG. 16 is a top view of the POU of FIG. 15.

As shown in FIG. 12, the plug 23 is inserted into the outlet 11. To secure the plug 23 in the outlet 11, the cord 20 is "snapped" into the retainer 115, as shown in FIG. 13 and FIG. 14. Next, the body 110 is slid forward, abutting the plug 23, as shown in FIG. 15 and FIG. 16. The locking wedges 112 engage the teeth 133, locking the body 110 in position.

To remove the plug 23 from the outlet 11, the release tabs 114 are squeezed together, which disengages the locking wedges 112 from the teeth 133. The body 110 slides away from the plug 23. The stops 127 prevent the body 110 from sliding off of the arms 120. The cord 20 is removed from the retainer 115 and the plug 23 is removed from the outlet 11.

Figure 17:
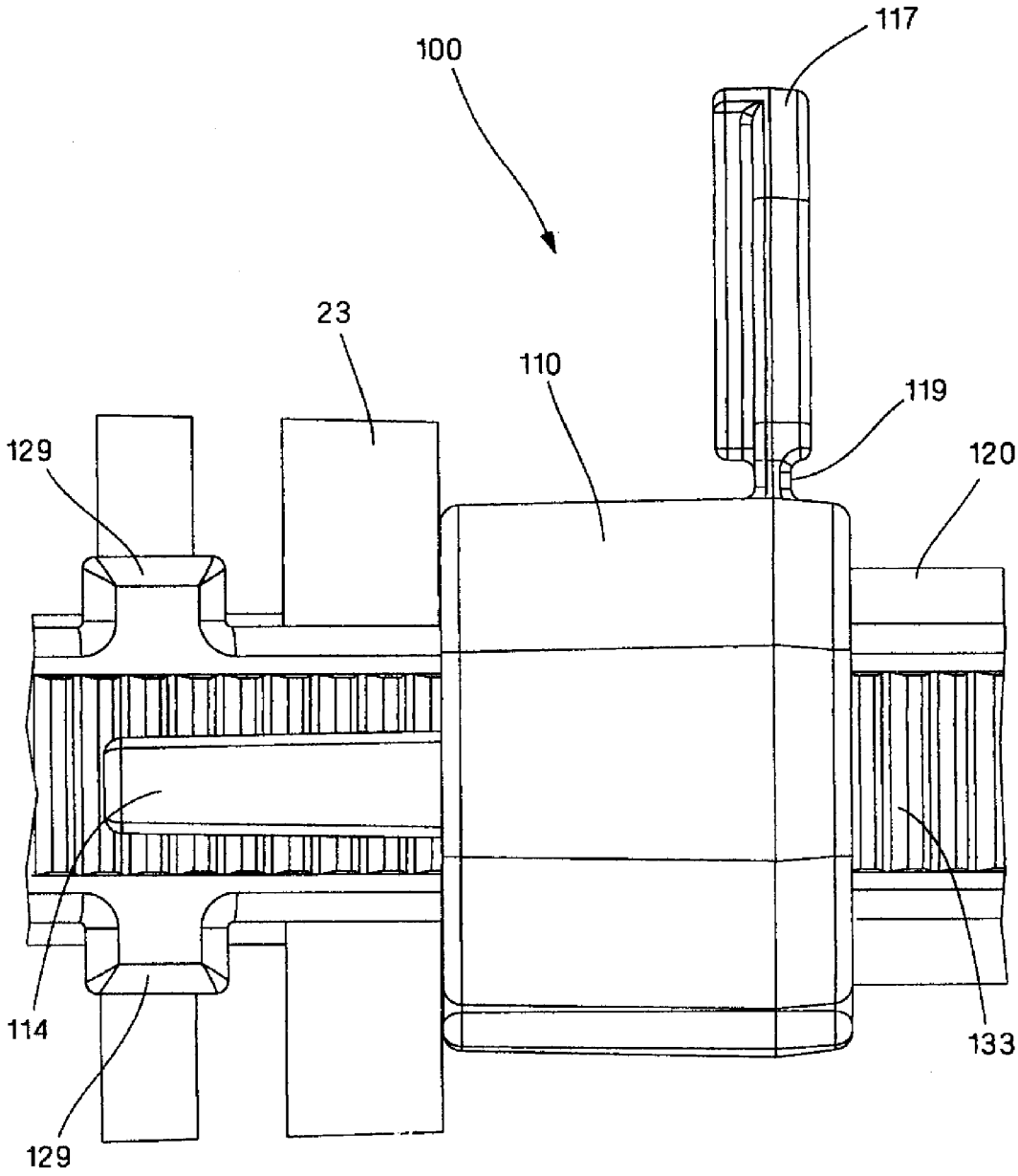
FIG. 17 is an enlarged side view of the plug retention device of FIG. 15, showing the plug identification area.
Figure 18:
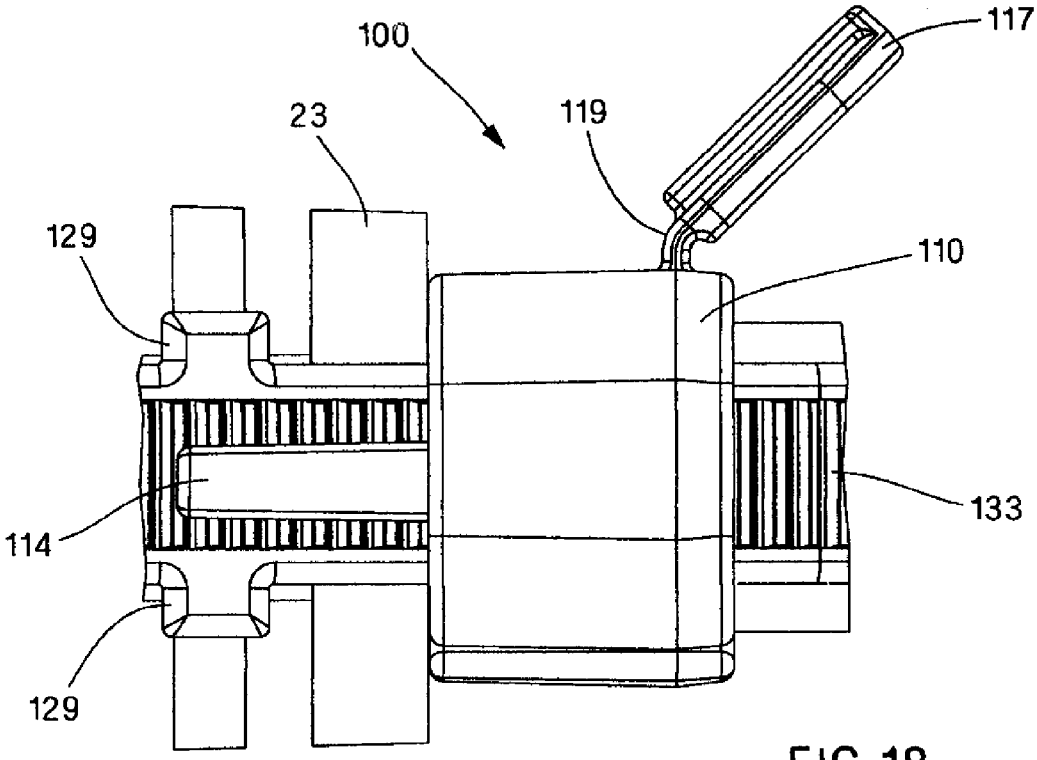
FIG. 18 is an enlarged side view of the plug retention device of FIG. 15, showing the plug identification area rotated forward.
Figure 19:
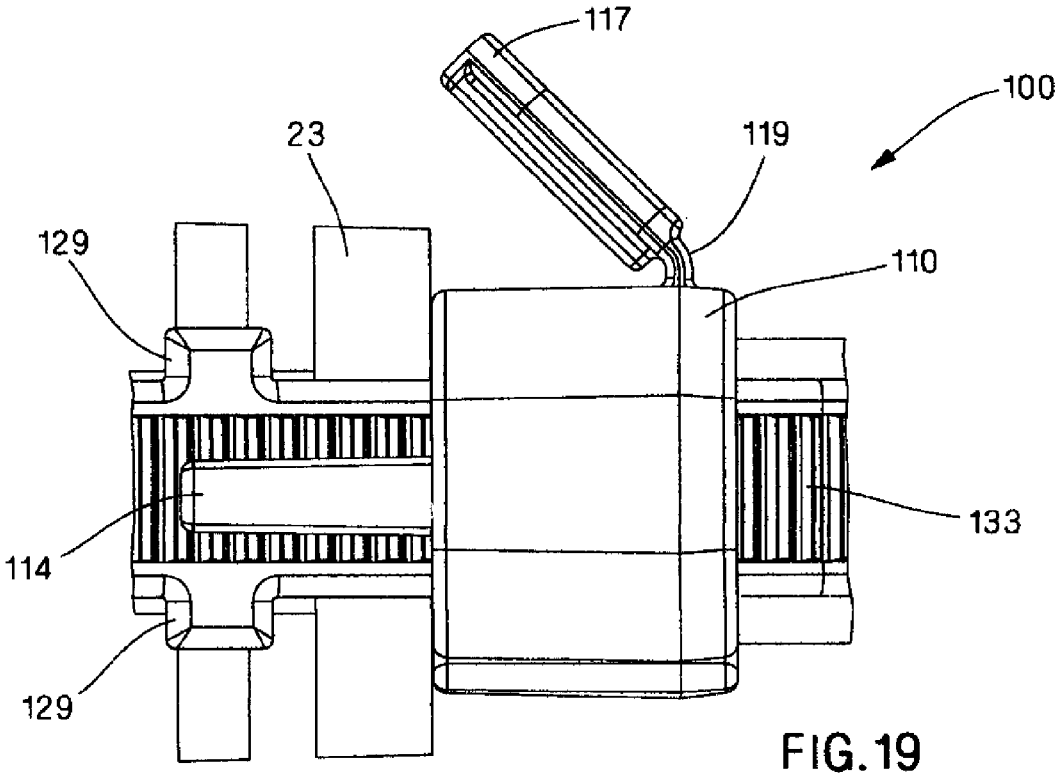
FIG. 19 is an enlarged side view of the plug retention device of FIG. 15, showing the plug identification area rotated backward.

Referring again to FIGS. 1-3, the body 110 includes a plug identification area 117. The plug identification area 117 includes a recess 118. The recess 118 is adapted to receive a label and a label cover, such as labels and label covers for the ULTIMATE ID® Network Labeling System (Panduit Corporation, Tinley Park, Ill.). Additionally, or in the alternative, the recess 118 may be textured (not shown), which allows a user to write on the plug identification area 117 with a marking pen. As best seen in FIGS. 17-19, the plug identification area 117 is rotatably connected to the body 110 via a hinge 119, which allows the plug identification area 117 to be rotated to a desired viewing angle. The hinge 119 is not resilient, and therefore, the plug identification area 117 will remain at the desired viewing angle until it is changed.

While the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The illustrated embodiments are examples only and should not be taken as limiting the scope of the present invention. The claims should not be read as limited to the described order or elements unless stated to that effect. Therefore, all embodiments that come within the scope and spirit of the following claims and equivalents thereto are claimed as the invention.

The invention claimed is:

1. An apparatus for retaining a plug in an outlet, the apparatus comprising:

a body; and a pair of arms slidably connected to the body, the body including a pair of slots for receiving the arms, each of the slots including a locking wedge, the locking wedge including a release tab, wherein the arms are secured to the outlet, and wherein the locking wedges allow the body to slide along the arms in a first direction and prevent the body from sliding along the arms in a second direction opposite the first direction to retain the plug in the outlet.

2. The apparatus of claim 1, wherein squeezing the release tabs together causes the locking wedges to rotate away from the arms, which allows the body to slide freely along the arms in the second direction.

3. The apparatus of claim 1, wherein the body includes a retainer for a cord.

4. The apparatus of claim 3, wherein the retainer is contoured to match the shape of the cord.

5. The apparatus of claim 3, wherein the retainer is resilient to accommodate a variety of cords.

6. The apparatus of claim 1, wherein the body includes a plug identification area.

7. The apparatus of claim 6, wherein the plug identification area includes a recess.

8. The apparatus of claim 7, wherein the recess is adapted to receive at least one of a label and a label cover.

9. The apparatus of claim 7, wherein the recess is textured.

10. The apparatus of claim 6, wherein the plug identification area is rotatably connected to the body via a hinge.

11. The apparatus of claim 10, wherein the hinge is non-resilient.

12. The apparatus of claim 1, wherein each of the arms includes a first end and a second end opposite the first end.

13. The apparatus of claim 12, wherein the first end includes a tip that is shaped like an arrow.

14. The apparatus of claim 13, wherein the first end includes a pair of tabs spaced apart from the tip that define a pair of recesses therebetween.

15. The apparatus of claim 14, wherein the tip is bent.

16. The apparatus of claim 12, wherein at least one of the first end and the second end includes an aperture.

17. The apparatus of claim 12, wherein the second end includes a first pair of stops.

18. The apparatus of claim 17, wherein the second end includes a second pair of stops spaced apart from the first pair of stops.

19. The apparatus of claim 1, wherein each of the arms includes a first side and a second side opposite the first side.

20. The apparatus of claim 19, wherein the first side includes a first set of teeth.

21. The apparatus of claim 20, wherein the second side includes a second set of teeth.

22. An apparatus for retaining a plug in an outlet, the apparatus comprising:

a body; and a pair of arms slidably connected to the body, each of the arms including a first end and a second end opposite the first end, the first end including a tip that is shaped like an arrow and a pair of tabs spaced apart from the tip that define a pair of recesses therebetween, wherein the arms are secured to the outlet, and wherein the body slides along the arms in a first direction to retain the plug in the outlet.

23. The apparatus of claim 22, wherein the tip is bent.

24. The apparatus of claim 22, wherein the first ends of the arms are secured to the outlet.

25. An apparatus for retaining a plug in an outlet, the apparatus comprising:

a body; and a pair of arms slidably connected to the body, each of the arms including a first end and a second end opposite the first end, the second end including a first pair of stops and a second pair of stops spaced apart from the first pair of stops, wherein the arms are secured to the outlet, and wherein the body slides along the arms in a first direction to retain the plug in the outlet.

26. The apparatus of claim 25, wherein the first ends of the arms are secured to the outlet.

27. An apparatus for retaining a plug in an outlet, the apparatus comprising:

a body; and a pair of anus slidably connected to the body, each of the arms including a first side and a second side opposite the first side, the first side including a first set of teeth and the second side including a second set of teeth, wherein the arms are secured to the outlet, and wherein the body slides along the arms in a first direction to retain the plug in the outlet.

28. An apparatus for retaining a plug in an outlet, the apparatus comprising:

a body; and a pair of arms slidably connected to the body, each of the arms including a first end and a second end opposite the first end, the first end including a tip and a pair of tabs spaced apart from the tip that define a pair of recesses therebetween, wherein the arms are secured to the outlet, and wherein the body slides along the arms in a first direction to retain the plug in the outlet.

29. The apparatus of claim 28, wherein the tip is shaped like an arrow.

30. The apparatus of claim 28, wherein the tip is bent.

31. The apparatus of claim 28, wherein the first ends of the arms are secured to the outlet.

* * * * *